United States Patent [19]

Labbe

[11] Patent Number: 4,464,919

[45] Date of Patent: Aug. 14, 1984

[54] WIRE STRAIGHTENER AND METHOD FOR STRAIGHTENING WIRE

[76] Inventor: Robert A. Labbe, 2375 NE. Ocean Blvd., Apt. 401-D, Stuart, Fla. 33494

[21] Appl. No.: 328,945

[22] Filed: Dec. 9, 1981

[51] Int. Cl.[3] ..... B21D 3/02; B21F 1/02

[52] U.S. Cl. ..... 72/162; 140/147; 242/78

[58] Field of Search ..... 72/160–162, 72/164, 169, 289; 140/147; 242/78, 78.6

[56] References Cited

U.S. PATENT DOCUMENTS

| | | | |
|---|---|---|---|
| 85,917 | 1/1869 | Downing | 72/162 |
| 537,652 | 4/1895 | Smith | 72/162 |
| 2,084,746 | 6/1937 | Roberts | 72/162 |
| 2,517,309 | 8/1950 | Heller | 72/162 |
| 2,567,770 | 9/1951 | Heller | 72/162 |
| 2,693,219 | 11/1954 | Heller | 140/147 |
| 2,724,422 | 11/1955 | Siegerist | 72/78 |
| 2,984,285 | 5/1961 | Simich et al. | 72/165 |
| 3,029,845 | 4/1962 | Egedal | 140/147 |
| 3,196,656 | 7/1965 | Johnston | 72/162 |
| 3,893,316 | 7/1975 | Simich | 72/162 |
| 3,982,402 | 9/1976 | Lang et al. | 72/161 |

*Primary Examiner*—Daniel C. Crane

*Attorney, Agent, or Firm*—St. Onge, Steward, Johnston & Reens

[57] ABSTRACT

A device for straightening wire, particularly coiled wire, is disclosed. The device includes at least two banks of rollers that are pivotally mounted with respect to a supporting base.

21 Claims, 12 Drawing Figures

10
12
14
16
18
34
36a
36b
36c
38
40a
40b
40c
48
50
88
90
92

WIRE STRAIGHTENER AND METHOD FOR STRAIGHTENING WIRE

BACKGROUND OF INVENTION (1) Field of the Invention

The present invention relates to a device and a method for straightening wire, and, more particularly, the present invention relates to straightening of coiled wire.

(2) Description of the Prior Art

In various types of manufacturing equipment, it is necessary to supply the equipment with wire that is precisely straight. Typically, wire is manufactured and then reeled or coiled for ease of storage, shipment and handling. Coiled wires are ordinarily annealed slightly so that the wire retains its coiled shape.

One device for straightening wire is disclosed in U.S. Pat. No. 2,567,770 to Heller. The Heller patent discloses a wire straightener comprising a plurality of banks of wire-guiding rollers. Each bank includes at least three rollers, all aligned in a common plane. The banks of rollers are arranged in angular position to each other.

U.S. Pat. No. 2,517,309, also to Heller, discloses a wire straightener for straightening coiled wire, wherein a first bank of rollers is positioned in a plane perpendicular to the plane of a second bank of rollers and wherein both banks are held in stationary position with respect to a coil of wire as it is uncoiled.

Other wire straighteners are disclosed in U.S. Pat. Nos. 2,724,422 to Siegerist; 2,984,285 to Simich et al; and 3,029,845 to Egedal.

In prior art straighteners, when it is desired to straighten coiled wire, the coil is positioned for rotation adjacent to the straightening device and the wire from the coil is fed into the straightener. The wire being uncoiled has what is known as a "Coil set," that is, the wire has an arcuate bend that lies in a plane, which plane will hereinafter be referred to as the "arc plane." As the coil is unwound, the wire is dispensed from various tangential points along the length of the coil. More specifically, the point at which the wire is dispensed from the coil will continuously move along the length of the coil from one end of the coil to the other ends and then back again to the first end of the coil. Thus, as the wire is uncoiled, the angle of the arc plane of the wire varies with respect to the straightener as the point at which the wire is dispensed from the coil varies along the length of the coil.

It is disadvantageous to have the angle of the arc plane of the wire vary with respect to the staightener for several important reasons. Firstly, the coiled wire may not be straightened within desired tolerances along the entire length of the wire. It should be understood that the position of the rollers is set so as to straighten a wire that is fed into the staightener at a constant angle between the arc plane and the straightener. After the rollers are set, and straightening of the wire begins on a continuous basis, the angle between the arc plane and the straightener of the wire varies from the angle at which the rollers were first set. Thus, the wire leaving the straightener may be straight within certain tolerances for portions of the length of the wire while other portions of the wire may be out of tolerance.

Another disadvantage of feeding the wire into the straightener at varying arc plane angles is that the initial rollers, that is the first, second and third rollers of the straightener are worn quickly because their surfaces are forced to adapt to wires being fed into the straightener at various angles.

Thus, in order to overcome the above described disadvantages, it is an object of the present invention to provide a straightener that maintains a substantially constant angle between the wire arc plane and the plane of the first set of rollers during uncoiling of the wire.

A further disadvantage of the prior art straighteners described in the two Heller patents is that the mechanisms for adjusting the relative positions of the rollers are complex. Further, some of the rollers of prior art devices are stationary and cannot be adjusted. It is an object of the present invention to provide rollers that can be independently adjusted of each other.

A further disadvantage of the wire straighteners described in the Heller patents is that they cannot be readily adapted to receive wire from both a right-hand coil, which is the most prevalent type of coil, or a left-hand coil. It is an object of the present invention to provide a straightener that can straighten wire form either a right-hand coil or a left-hand coil.

SUMMARY OF THE INVENTION

A straightener in accordance with the present invention is particularly suited for straightening wire from a coil. The straightener includes a first bank of rollers for guiding the wire for longitudinal movement in a first plane. The first bank of rollers has at least three rollers each having a surface for contacting and bending the wire. The roller surfaces are spaced longitudinally from each other and are offset laterally within the first plane. The device also includes a second bank of rollers for guiding the wire for longitudinal movement in a second plane that is offset relative to the first plane, and, preferably, offset by an angle of about ninety degrees.

The straightener includes a mechanism for maintaining a substantially constant angle between the arc plane of the wire being dispensed from the coil and the plane of the first bank of rollers. In accordance with one aspect of the invention, the banks of rollers are mounted for pivotal movement about an axis parallel to the first roller plane. As the angle between the arc plane of the wire and the straightener device varies as the wire is being uncoiled from different points along the length of the coil, the banks of rollers freely pivot about the axis to maintain a substantially constant angle between the wire arc plane and the plane of the first bank of rollers. Most preferably, the angle between the wire arc plane and the plane of the first bank of rollers is preferably maintained at an angle of approximately zero while the angle between the wire arc plane and the straightener device may vary as much as plus or minus 30 degrees or more.

In accordance with one aspect of the invention, the straightener includes a base for pivotally supporting a bracket upon which the banks of rollers are mounted. The bracket includes front plate on which the first bank of rollers are mounted and a rear plate on which the second bank of rollers are mounted. Preferably, the bracket is formed in a single piece wherein the front plate is positioned transversely to the rear plate and the entire bracket is mounted by a suitable pivot mechanism for pivoting about an axis parallel to both the first and second roller plates.

In order to provide for independent adjustment of each of the rollers each roller is mounted on a shaft having a central axis about which the roller rotates. The shaft includes an elongate hole offset from and extending parallel to the central axis of the shaft. A fastener, such as, for example a bolt having a threaded end, extends through the offset hole and releasably secures the shaft in its position relative to the plate on which the roller is mounted. Thus, in order to adjust the position of the roller so that the surface that contacts the wire is either closer or further away from the wire path, the bolt can be loosened and the shaft of the roller rotated with respect to the shaft to a desired position. Thereafter, the bolt is tightened once again to secure the shaft in fixed position relative to the plate. Thus, each roller may be adjusted independently of the other rollers. However, it should be understood that while it is preferred that all of the rollers be adjustable, in some instances, it may be desirable to provide the staightening device with some rollers that are fixed and others that are adjustable.

In order to provide for a device that is capable of straightening wire from either right-hand coils or left-hand coils, the front plate on which the rollers of the first bank are mounted includes holes for securing each roller on either side of the path of the wire which is fed into the rollers. More specifically, with respect to either a left-hand or a right-hand coil, it is desirable for the first roller which contacts the wire to be located outside the arc of the wire and it is also preferred that the rollers along the length of the wire be spaced apart from one another and alternate on opposite sides of the wire path. By providing additional holes in the plates, each of the rollers on the front plate can be switched to the opposite side of the wire path to thereby accomodate either a right-hand or a left-hand coil. Moreover, it should be understood that for certain wires having an unusually high toughness, one or more of the rollers may have two or more positions located laterally closer to or away from the path of the wire. Thus, where the range of movement of an eccentrically mounted roller is not sufficient to position the roller to proper position, the roller may be moved closer to or farther away from the path of the wire by changing the location at which the roller is secured to its plate.

Further details and advantages of a wire straightener in accordance with the present invention will be described below with reference to the drawings.

BRIEF DESCRIPTION OF THE DRAWINGS

FIGS. 6, 7 and 8 are side views of the device shown in FIGS. 1–5 shown in different positions wherein;

FIG. 6 is a side view of the device straightening wire disposed from the top of the coil;

FIG. 7 is a side view of the device straightening disposed from the center of the coil;

FIG. 8 is a side view of the device straightening wire disposed from the bottom of the coil;

DETAILED DESCRIPTION OF THE INVENTION

Figure 1:
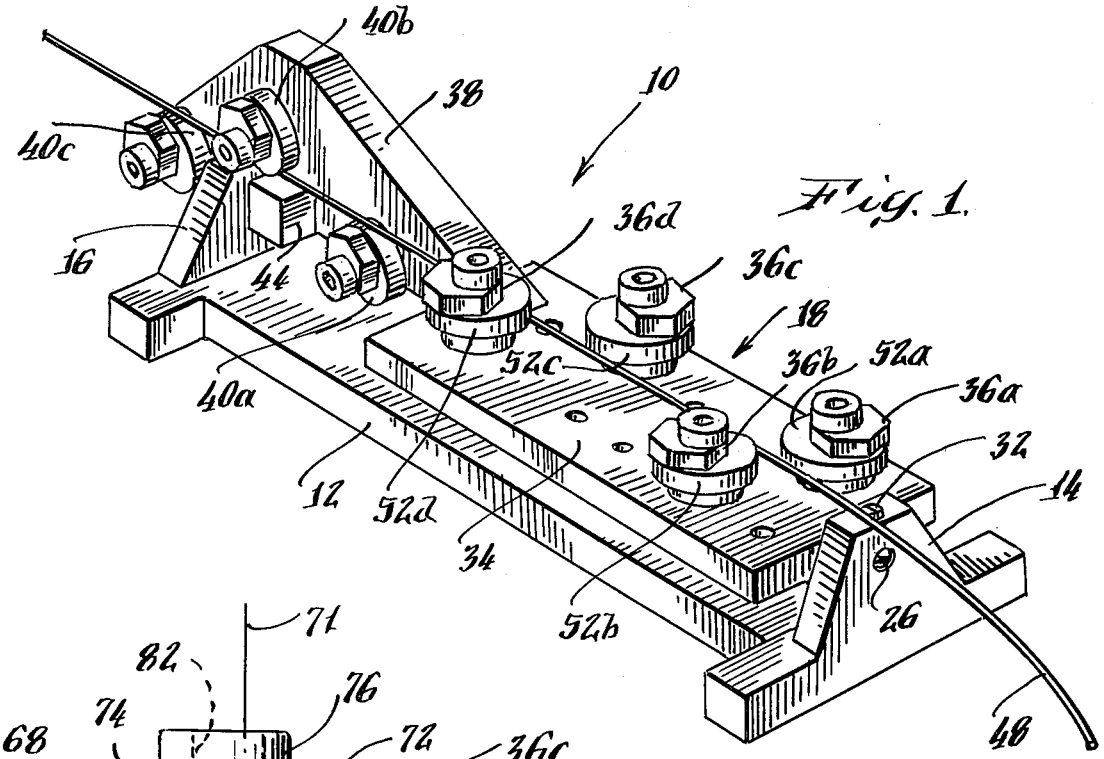
FIG. 1 is a perspective view of a wire straightener in accordance with the invention.
Figure 2:
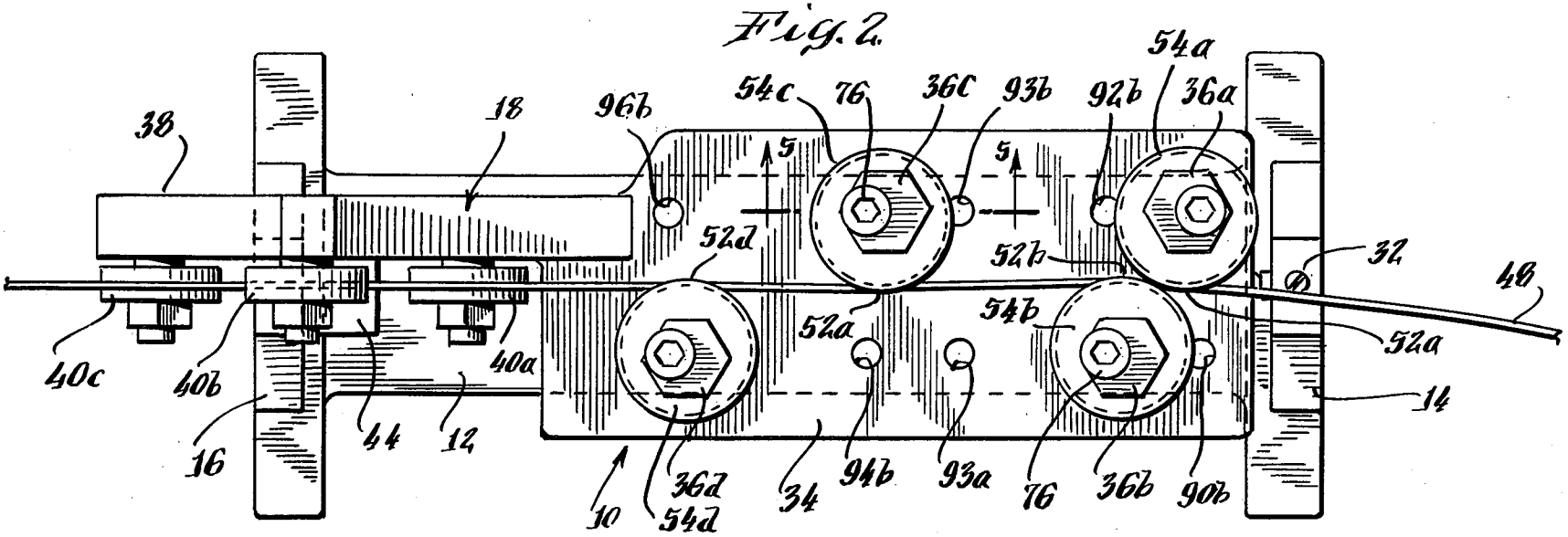
FIG. 2 is a top plan view of the wire straightener shown in FIG. 1.
Figure 3:
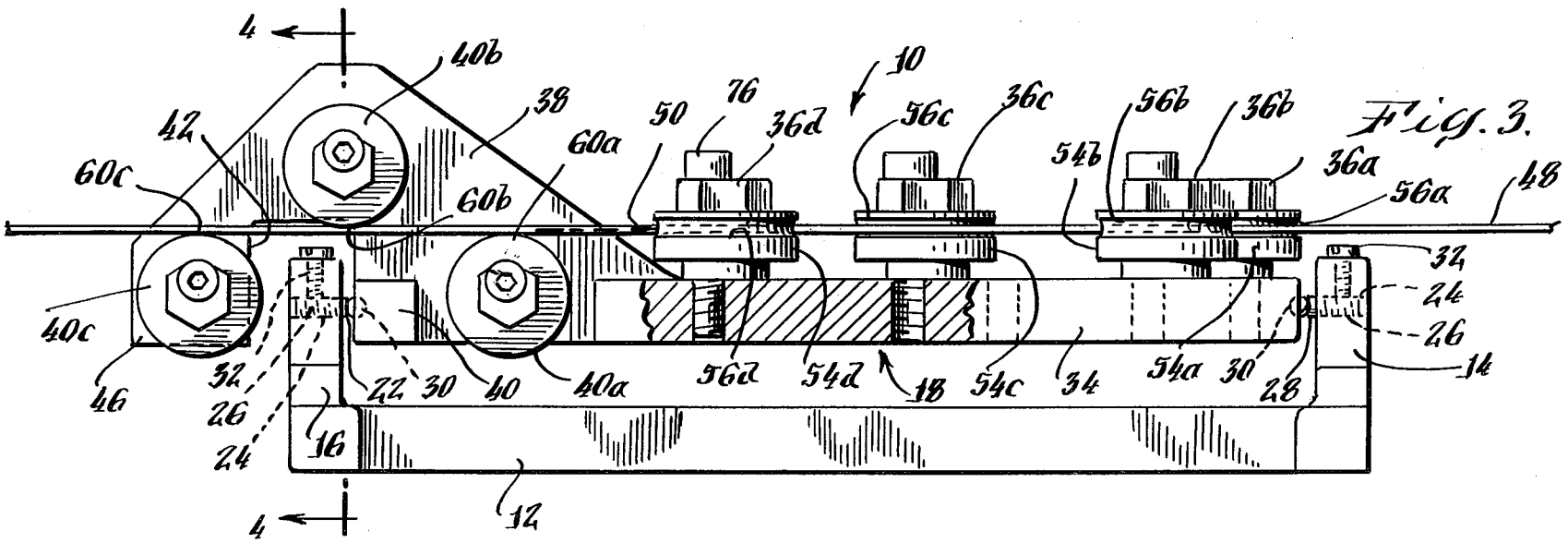
FIG. 3 is a side plan view of a wire straightener shown in FIGS. 1 and 2.

Referring to FIGS. 1–3, the straightening device 10 comprises a supporting base 12 that has a generally flat, rectangular shape having at both ends thereof vertical supports 14 and 16. The supporting base 12 may be made of any suitable material, such as, for example a cast iron alloy and can have various shapes suitable for attachment to a particular machine or piece of equipment that requires straightened wire.

The straightening device 10 further includes a bracket 18 which is pivotally mounted to supports 14 and 16 of the base 12 by pivot mechanisms 20 and 22. As shown particularly well in FIGS. 2 and 3, each support 14 and 16 includes a longitudinal aperture 24 for receiving a cylindrical pin 26 having on the interior end thereof a semispherical seat 28. The bracket 18 includes at both end portions a spherical ball 30 protruding outwardly therefrom which is received by socket 28. For the purposes of allowing adjustment and repair of the bracket 18 or the rollers thereon, the bracket 18 may be removed from its pivotal mounting by unscrewing set screws 32 and moving pins 26 outwardly. It should be understood that the abovedescribed mechanism for pivotally mounting bracket 18 is one that has been found to be particularly simple and effective. However, it should be understood that various types of known mechanisms for allowing pivotal movement may be used.

Referring in particular to FIG. 1, as well as FIGS. 2 through 5, the pivotal bracket 18 includes a front plate 34 on which a first bank of rollers **36*a*, 36*b*, 36*c* and 36*d* are mounted. The bracket 18 also includes a rear plate 38 on which a second bank of rollers 40*a*, 40*b* and 40*c* are mounted. It is preferred that bracket 18** be made in a single piece, such as, for example, from a cast iron alloy.

As shown particularly well in FIGS. 1 and 2, plate 38 includes an upwardly extending recess 42 that is sufficiently large to fit over support 16 without contacting it. The plate 38 includes a protrusion 44 extending outwardly from its face that provides for seating of spherical ball 30 (see FIG. 3). It should be understood that the above-described location of the pivot provides for a compact straightener device. However, it should be understood that the bracket 18 may also be mounted for pivotal movement about its left end 46 (see FIG. 3).

Figure 5:
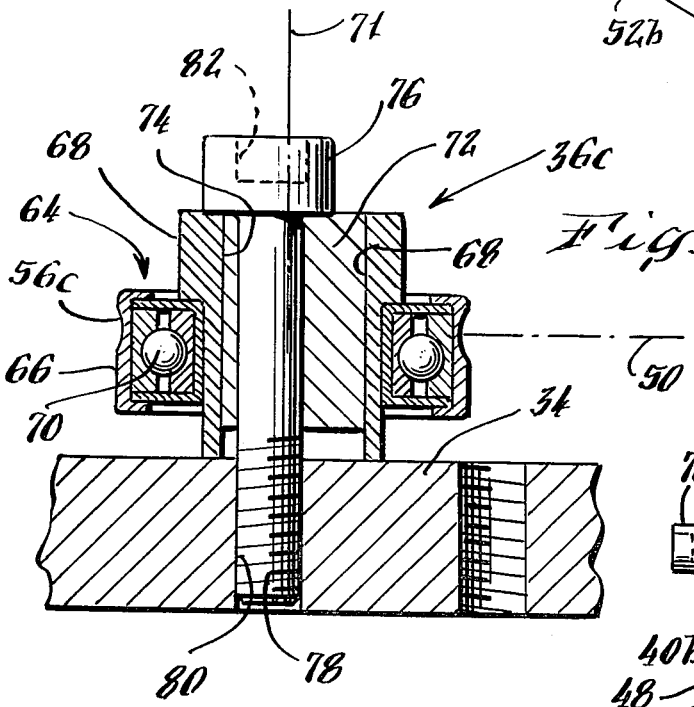
FIG. 5 is a sectional view along the plane 5—5 of FIG. 2.

As shown particularly well in FIGS. 2 and 3, the first bank of rollers 36 guide the wire 48 for longitudinal movement in a first plane 50 (see FIGS. 3 and 5). Each roller 36 includes a surface 52 that contacts and bends the wire upon longitudinal of the wire through its path. It should be understood that the first bank of rollers should include at least three and preferably four rollers wherein each roller is spaced longitudinally apart from the other rollers and each roller is offset laterally from the other rollers within plane 50. As shown particularly well in FIG. 3, each of the rollers has an outer cylindrical surface 54 including a guide groove 56 for guiding the wire in plane 50. The guide grooves 56 prevent the wire 48 from slipping downwardly under the force of gravity out of plane 50.

Figure 4:
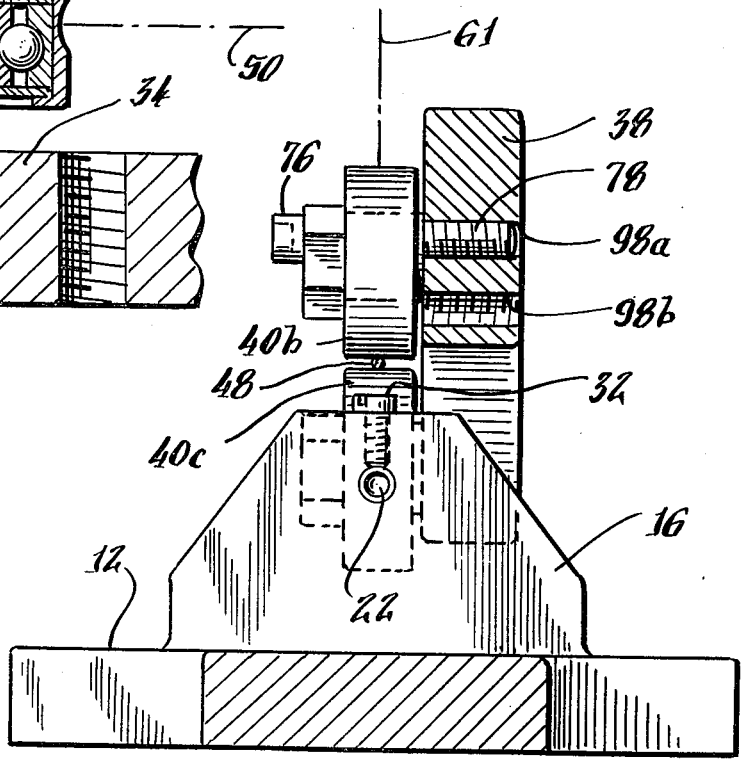
FIG. 4 is a sectional view along the plane 4—4 of FIG. 3.

The second bank of rollers 40 guide the wire for longitudinal movement in a second plane 61 (see FIGS. 2 and 4). Plane 61 is angularly offset from plane 50, and, most preferably offset from plane 50 by an angle of about ninety degrees. Each roller 40 includes a surface 60 for contacting and bending the wire upon longitudinal movement of the wire through its path. The rollers, and thus their surfaces 60 are spaced longitudinally from each other and offset laterally from each other within the second plane 61.

The internal construction of the rollers 36 and 40 will now be described with reference to FIG. 5. Roller **36*c* comprises a conventional roller 64 having an outer race 66 that is rotatable with respect to a roller shaft 68 about central axis 71. The particular roller shown in FIG. 5 includes spherical ball bearings 70 to reduce friction between the outer race 66 and shaft 68 as the outer race rotates. It should be understood, however, that various types of known rollers or other mechanisms for guiding the wire can by used in the practice of the present invention, and the particular roller 36*b*** is shown by way of example only.

The roller **36*c* further includes an interior shaft including an elongate hole 74 that is offset from and that extends parallel to central axis 71. The interior shaft 72 is force fitted into sleeve 68 so that it is fixed with respect thereto. The device further includes a bolt 76 for securing the shaft 72 in fixed position relative to the plate 34 on which roller 36*c* is mounted. The bolt 76 includes threads 78 on one end thereof and the plate 34 includes a threaded hole 80 for receiving threads 78** of the bolt. The upper end of the bolt includes a hexagonal socket for receiving a wrench that can either loosen or tighten the bolt.

In order to adjust the position of the surface **52*c* which contacts the wire, the bolt is loosened to allow the roller to be rotated in an eccentric manner about bolt 74 so that surface 52** is either closer to or farther away from the path of the wire. Thus, each roller is adjustable independently of the other rollers.

The rollers 40 as shown in FIG. 4 have internal construction identical to rollers 36 except that rollers 40, are preferably smaller in diameter than rollers 36 as can be shown in a comparison between FIGS. 2 and 3. Moreover, rollers 40 differ from rollers 36 in that they do not require the use of a guide groove such as guide groove **56*c* of roller 36*c***.

Figure 6:
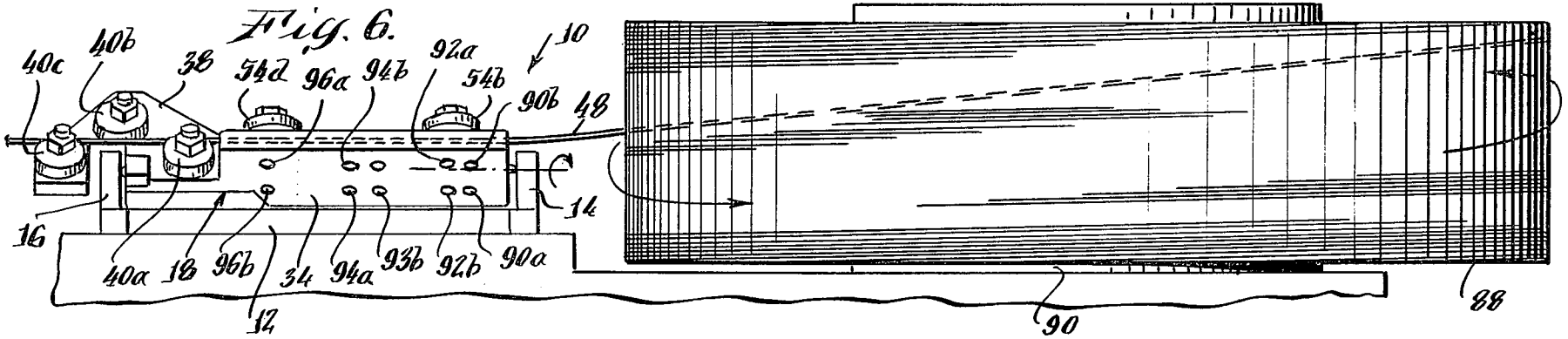
Figure 7:
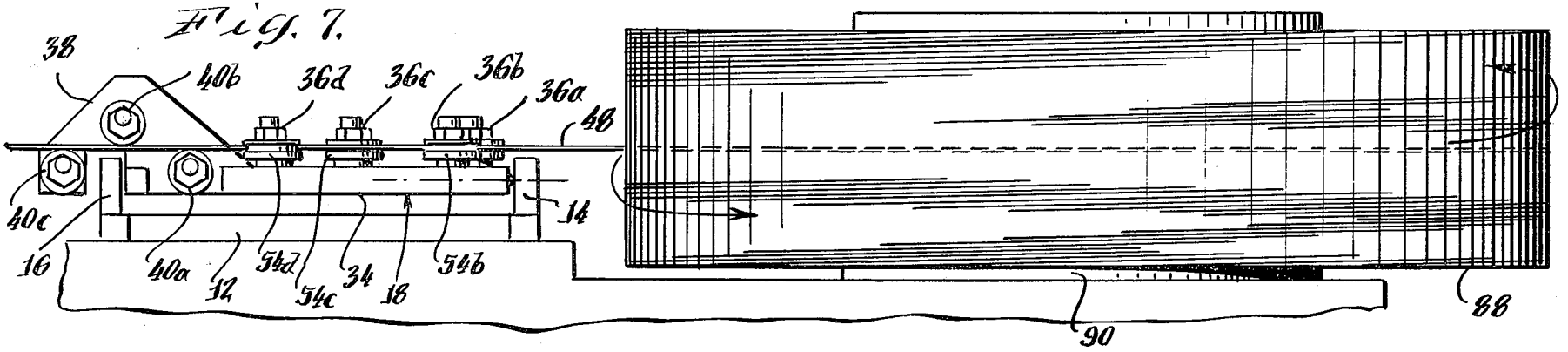
Figure 8:
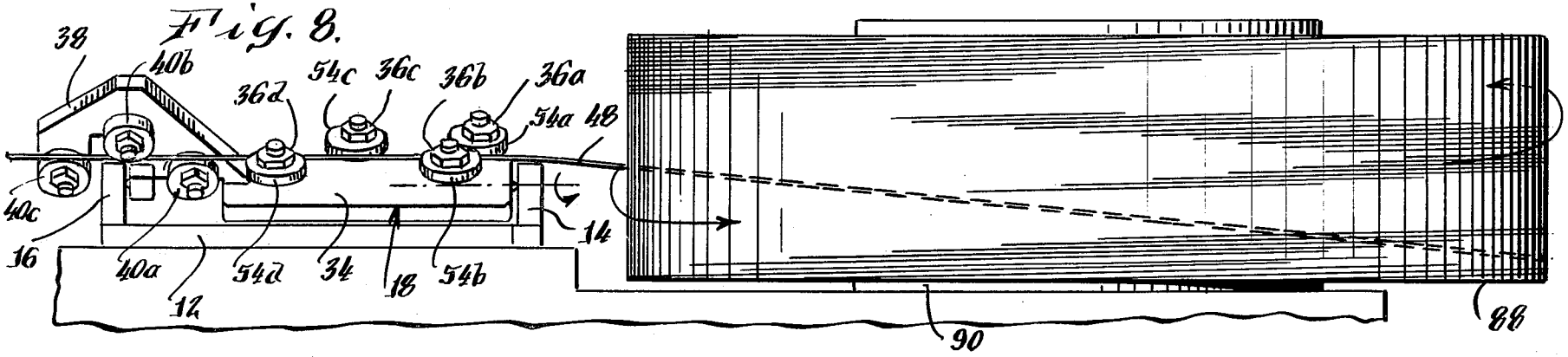
Figures 9, 10, 11, 12:
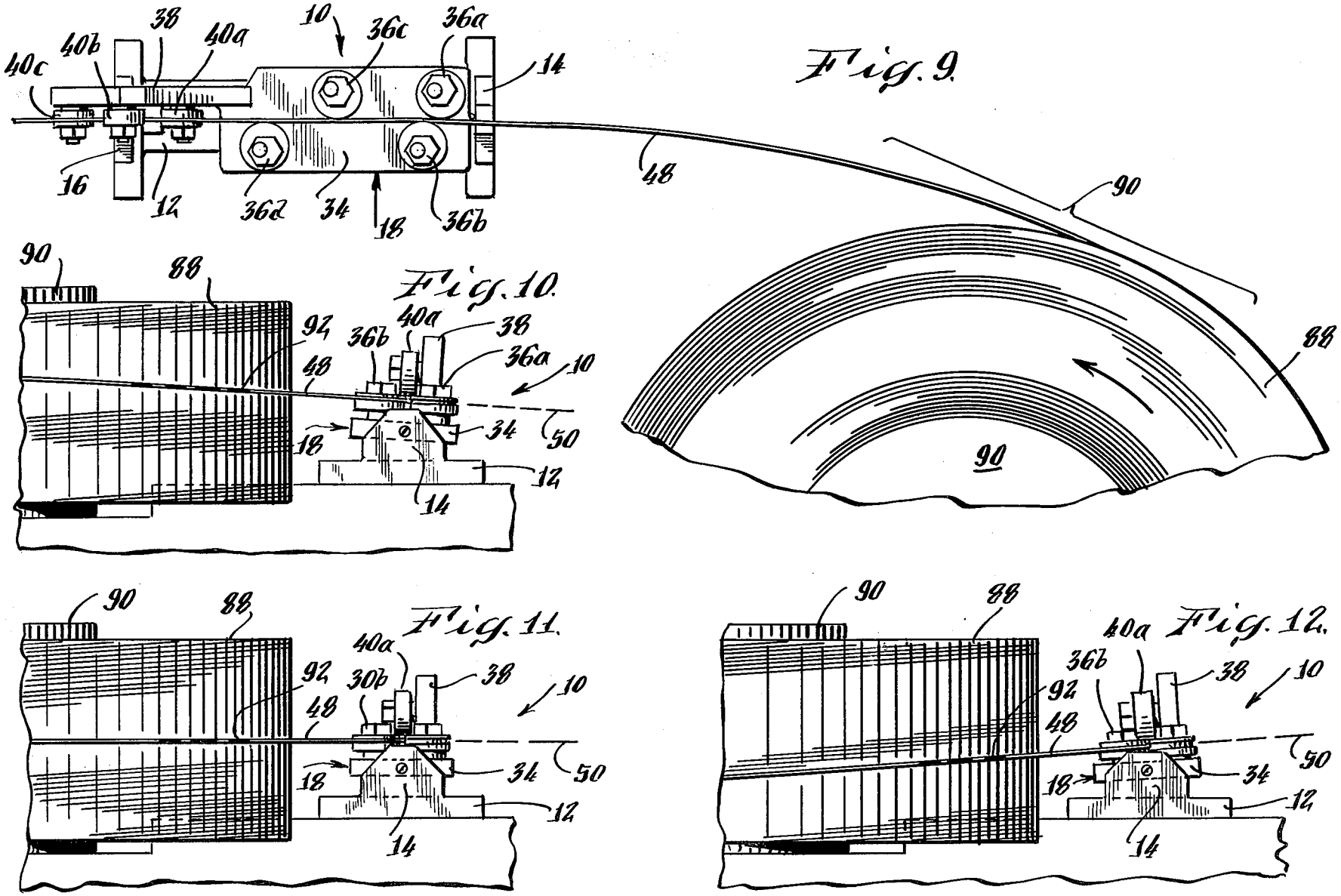
FIG. 9 is a top schematic plan view of the device shown in FIG. 7.
FIG. 10 is a front schematic view of the device in the position shown in FIG. 6.
FIG. 11 is a front schematic view of the device in the position shown in FIG. 7.
FIG. 12 is a front schematic view of the device in the position shown in FIG. 8.

Referring to FIGS. 6–12, the use of the wire staightener in accordance with the present invention to straighten wire from a coil will now be described in detail. As shown in FIGS. 6–12, a coil of wire 88 is positioned for rotation on spindle 90 adjacent to the staightening device 10. As shown particularly well in FIG. 7, the wire 48 being uncoiled from coil 88 has an arcuate bend 90 that lies substantially in a single plane 92, hereinafter referred to as the "arc plane." As the wire is unwound from the coil 88, the wire is dispensed from different points along the length of coil 88. More particularly, referring to FIGS. 6–12, the wire is dispensed from the top of the coil as shown in FIGS. 10 and 6. As the wire continues to unwind, the point on the length of the coil at which the wire is dispensed continuously moves downwardly. FIGS. 7, 9 and 11 show the wire after it has moved to a point where it is dispensed from a central part of the coil. As the coil is unwound further, it is dispensed from the bottom of the coil as shown in FIGS. 8 and 12. As the uncoiling process continues, the location from which the wire is dispensed from the coil 88 moves through a cyclical motion up and down. Thus, as the wire is dispensed from different points along the length of the coil, the angle of the arc plane 92 with respect to the device varies along the length of the coil, the angle of the arc plane 92 with respect to the device varies along the length as the wire is uncoiled. (see FIGS. 10–12)

As best shown in FIGS. 6 through 12, the previously described mechanism for pivoting the bracket which supports the banks of rollers enables a substantially constant angle to be maintained between the arc plane 92 and the first plane 50 of the first bank of rollers 36 during uncoiling of the wire. As shown in FIGS. 6–12, the angle between the arc plane of the wire and the first plane 50 of the first bank of rollers 36 is preferably coincident with the plane 50 of the first bank of rollers. Because the angle at which the wire is fed into the first bank of rollers is maintained during uncoiling of the wire, the first bank of rollers effectively removes the "coil set" of the wire since the bending of the wire occurs in the same plane as the coil set of the wire.

In addition to providing a continuously straight wire within desired tolerances, the pivoting of the banks of rollers during uncoiling of the wire has the advantage that the surfaces of the roller tend to wear less thus reducing the incidence of repair and replacement of the rollers. Further, since the wire is pulled by equipment located downstream of the straightener with a relatively constant force, it is desired to have a constant amount of friction imposed on the wire that passes through the rollers. By maintaining a substantially constant angle between the arc plane 92 of the wire and the plane 50 of the first bank of rollers, the friction on the wire is held substantially constant and is reduced.

The coil 88 shown in FIGS. 6–12 is what is known as a "right-hand" coil. The straightening device of the present invention is easily adapted to straighten wire from a "left-hand" coil. With respect to either a left-hand or a right-hand coil, it is desirable for the first roller 36 which contacts the wire 48 be located outside of the arc of the wire as shown particularly well in FIGS. 1 and 9. In order to enable all of the rollers 36 on a front plate 34 to be switched from the position shown in the figures to a position opposite of the wire path, for each roller on plate 34, the plate includes at least two holes located on opposite sides of the wire path. More specifically, referring to FIGS. 2 and 6, roller **36*a* is mounted in hole 90*a* for a right-hand coil but for a left-hand coil would be repositioned by unscrewing the bolt fastener 76 and moving the roller 36*a* to hole 90*b*. Roller 36*b* would be moved from hole 92*a* to hole 92*b*; roller 36*c* would be moved from hole 94*a* to hole 94*b*; and roller 36*b* would be moved from hole 96*a* to hole 96*b*. Thus, the position of the rollers 36 on the first plate 34** may be changed to accomodate either a left-hand or a right-hand coil.

In order to accomodate wires having different diameters, the plate may include additional holes for bearing **36*b*. More particularly, referring to FIGS. 2 and 6, additional holes 93*a* and 93*b* are provided. For relatively small diameter wires, that is, wires in the diameter range of 0.030–0.093 inches, holes 93*a* and 93*b* should be used for roller 36*b*. For relatively large diameter wires, that is, for example, wires having a diameter in the range of 0.093–0.156 inches, holes 92*a* and 92*b*** should be used.

Referring to FIG. 4, for roller 42*e*, the roller has two holes 98*a* and 98*b* to provide for maximum adjustment for tougher materials such as stainless steels or bronze materials having a high toughness. It should be understood that although in the preferred form of the invention, only roller 40*b* has more than one hole to accomodate tough wires, it may be desired for a particular purpose for one or more of the other rollers to have more than one mounting hole to accomodate tougher wires.

With respect to the functions of each of the rollers, roller 36*a* primarily functions to offset the natural curve of the wire and to locate it in a central position. Roller 40*a* should be positioned to keep the wire on a horizontal plane as it comes through the first bank of rollers while roller 40*c* should be positioned to keep the wire on a horizontal plane as it enters the equipment which processes the wire.

In summary, the straightening device in accordance with the invention maintains a substantially constant angle between the arc plane of the wire being fed into the device and the plane of the first bank of the rollers to provide a wire staightened over its entire length. Moreover, since the feed angle of the wire remains substantially constant, wear on the rollers is reduced and the friction on the wire is maintained at a low and constant level. The device may be adjusted to accept either left-hand or right-hand coils and each roller of the device can be adjusted independently of the other rollers to enable the device to be adjusted precisely for a given type of wire.

It should be understood that although specific embodiments of the invention have been described herein in detail, such description is for purposes of illustration only and modification may be made thereto by those skilled in the art within the scope of the invention.

I claim:

1. A device for straightening wire from a helically wound coil comprising:

means for positioning said coil wherein said wire being uncoiled has a coil set lying generally in a plane, the angle of said plane with respect to said helical coil varying along the length of the coil as the wire is uncoiled;

first means for guiding said wire for longitudinal movement in a first plane, said guide means having at least three surfaces spaced longitudinally from each other and offset laterally from each other within said first plane for contacting and bending said wire upon longitudinal movement thereof, said coil positioning means located adjacent said first guide means;

second means for guiding said wire for longitudinal movement in a second plane angularly offset from said first plane, said second guide means having at least three surfaces spaced longitudinally from each other and offset laterally from each other within said second plane for contacting and bending said wire upon longitudinal movement thereof; and means for supporting said first and second guide means, said support means located in a fixed position with respect to said coil, said angle of said coil set varying with respect to said support means during uncoiling of said wire, said first guide means being mounted to pivot freely with respect to said support, said varying angle of the coil set of said wire pivoting said first guide means to maintain a substantially constant angle between said plane of the coil set and said plane of said first guide means while the said angle between said plane of the coil set and said fixed support means varies.

2. A straightening device according to claim 1 wherein said first guide means comprises a bank of at least three rollers for guiding the wire, each said roller having an outer cylindrical surface for contacting and bending said wire.

3. A straigtening device according to claim 2 wherein at least two of said three rollers each includes on the surface thereof a guide groove for guiding the wire in said first plane.

4. A straightening device according to claim 3 wherein said second guide means comprises a bank of at least three rollers for guiding the wire, each said roller having an outer cylindrical surface for contacting and bending said wire.

5. A straightening device according to claim 1 wherein said first and second guide means are mounted on a bracket and wherein said device includes a base for supporting said bracket, said means for maintaining a substantially constant angle comprising:

means for mounting said bracket for pivotal movement during straightening about an axis parallel to said first plane to provide for pivotal movement of said first guide means with respect to said coil to thereby maintain a substantially constant angle between said wire arc plane and said first plane during uncoiling of wire.

6. A straightening device according to claim 4 and further including a base for supporting said banks of rollers, said means for maintaining a substantially constant angle between said wire arc plane and said first plane comprising:

means for mounting said banks of rollers for pivotal movement about an axis parallel to said first roller bank plane.

7. A straightening device according to claim 6 wherein said angular offset between said first and second planes is about ninety degrees.

8. A straightening device according to claim 7 and including a bracket on which said banks of rollers are mounted, said bracket comprising a front plate on which said first bank of rollers is mounted and a rear plate on which said second bank of rollers is mounted.

9. A straightening device according to claim 8 wherein each said roller is mounted on a shaft having a central axis about which the roller rotates, said shaft including an elongate hole offset from and extending parallel to said central axis, and further including fastener means extending through said offset hole for releasably securing said shaft in fixed position relative to said plate on which the roller is mounted.

10. A straightening device according to claim 9 wherein for each said roller, said plate includes at least one means for securing said roller fastener to said plate, each said roller mounted on said first plate including sides of the path of the wire to enable the straightening device to be used for wire coiled in a right-hand direction and a left-hand direction.

11. A straightening device according to claim 10 and further including for each of at least two of said rollers mounted on said first plate, two means for securing located on the same side of the path of the wire to provide for gross adjustment of the device so as to accomodate wires of various diameters.

12. A straightening device according to claim 11 wherein each said roller fastener comprises an elongate bolt threaded at one end thereof and wherein said means for securing said roller fastener to said plate comprises a threaded hole for receiving said threaded bolt and, said bolt having at the top thereof a portion for engaging said roller shaft to secure it in fixed position when said bolt is threaded tightly into said threaded hole.

13. A device for straightening wire having a coil set comprising:

a supporting base;

first means for guiding said wire for longitudinal movement in a first plane, said guide means having at least three surfaces spaced longitudinally from each other and offset laterally from each other within said plane for contacting and bending said wire upon longitudinal movement thereof;

second means for guiding said wire for longitudinal movement in a second plane angularly offset from said first plane, said second guide means having at least three surfaces spaced longitudinally from each other and offset laterally from each other within said second plane for contacting and bending said wire upon longitudinal movement thereof; and means for positioning a source of wire adjacent said first guide means, said coil set of said wire having an angle with respect to said supporting base that varies over time as the wire is straightened, said varying angle of the coil set pivoting said first guide means with respect to said base to maintain a substantially constant angle between said coil set and said first guide means while said angle between said coil set and said base varies.

14. A straightening device according to claim 13 wherein said first guide means comprises a bank of at least three rollers for guiding the wire, each said roller having an outer cylindrical surface for contacting and bending said wire.

15. A straightening device according to claim 14 wherein at least two of said three rollers each includes on the surface thereof a guide groove for guiding the wire in said first plane.

16. A straightening device according to claim 15 wherein said second guide means comprises a bank of at least three rollers for guiding the wire, each said roller having an outer cylindrical surface for contacting and bending said wire.

17. A straightening device according to claim 1 wherein said first and second guide means are mounted on a bracket, said device including a base for supporting said bracket, and means for mounting said bracket for pivotal movement about an axis parallel to said first plane.

18. A straightening device according to claim 1 wherein said angular offset between said first and second planes is about ninety degrees.

19. A method for straightening wire from a coil comprising:

positioning a coil for rotation adjacent to a straightening device, said wire having a coil set lying substantially in a plane, the angle of said plane with respect to the device varying along the length of the coil as the wire is uncoiled;

passing the wire through a first means for guiding said wire for longitudinal movement in a first plane and for bending said wire at least three surfaces upon longitudinal movement of the wire;

passing said wire through a second means for guiding said wire for longitudinal movement in a second plane angularly offset from the first plane and bending said wire at least three surfaces in said second plane; and pivoting the said first guide means about an axis to maintain a substantially constant angle between said plane of the coil set and said first plane of said guide means while the angle between said coil set and said straightening device varies during uncoiling of said wire.

20. A method according to claim 19 and further including:

pivoting the first plane of said first guide means to maintain it coincident with said arc plane.

21. A method according to claim 20 wherein said plane of said first guide means and said plane of said second guide means are positioned in transverse relation to each other.

* * * * *